United States Patent [19]

Clark et al.

[11] 4,298,334

[45] Nov. 3, 1981

[54] DYNAMICALLY CHECKED SAFETY LOAD SWITCHING CIRCUIT

[75] Inventors: Rodney L. Clark, Burnsville; Kenneth B. Kidder, Coon Rapids; Gary A. Peterson, New Brighton, all of Minn.

[73] Assignee: Honeywell Inc., Minneapolis, Minn.

[21] Appl. No.: 97,471

[22] Filed: Nov. 26, 1979

[51] Int. Cl.[3] ..... F23Q 23/00

[52] U.S. Cl. ..... 431/24; 431/45; 431/60; 431/72; 340/515; 340/516

[58] Field of Search ..... 431/24, 25, 26, 45, 431/29, 49, 60, 67, 72, 73, 78; 340/515, 516, 644, 577, 578, 579; 371/23; 307/117

[56] References Cited

U.S. PATENT DOCUMENTS

| | | | |
|---|---|---|---|
| 3,202,976 | 8/1965 | Rowell | 340/515 |
| 3,288,195 | 11/1966 | Thomson | 340/515 |
| 3,683,372 | 8/1972 | Horn | 340/515 |
| 3,684,423 | 8/1971 | Bryant | 431/24 |
| 3,938,939 | 2/1976 | MacAskill, Jr. et al. | 431/79 |
| 3,958,126 | 5/1976 | Bryant | 431/24 |
| 3,967,281 | 6/1976 | Dageford | 340/415 |
| 3,999,944 | 12/1976 | Murphy | 431/15 |
| 4,024,417 | 5/1977 | MacAskill, Jr. | 307/117 |

*Primary Examiner*—James C. Yeung
*Assistant Examiner*—Lee E. Barrett
*Attorney, Agent, or Firm*—Alfred N. Feldman

[57] ABSTRACT

A control logic means or microcomputer controlled burner control system has been disclosed. The system utilizes a safety relay that has contacts that are in series with all of the other loads for the system. The safety relay contacts are checked prior to operation of the system to verify their ability to open the load circuit. The operation of the electronics for the control of the safety relay are regularly checked during the operation of the system by a combination of feedback circuits from the electronics, and from the final control element for the various loads.

10 Claims, 1 Drawing Figure

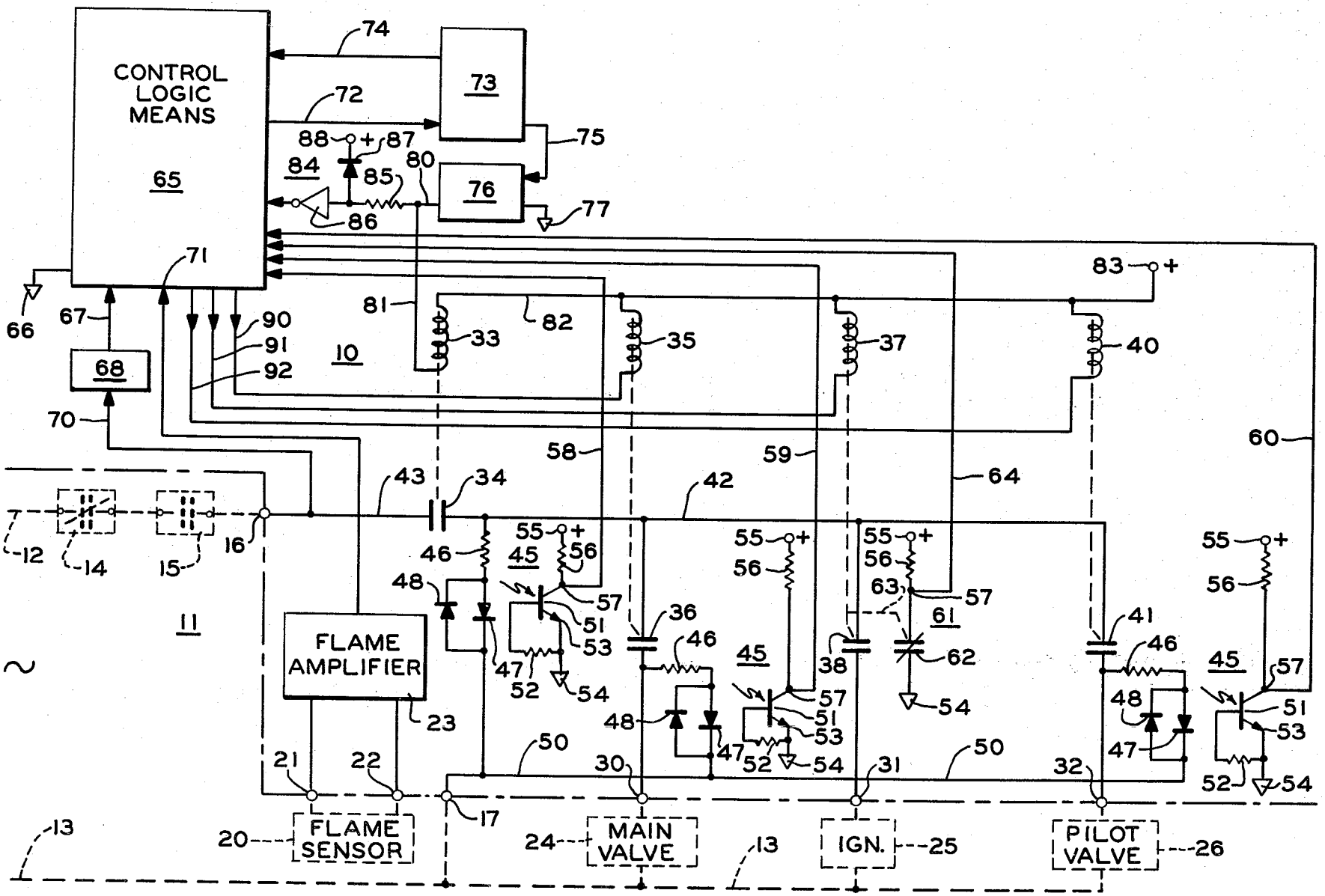
CONTROL LOGIC MEANS
65
FLAME AMPLIFIER
PILOT VALVE
IGN.
MAIN VALVE
FLAME SENSOR

DYNAMICALLY CHECKED SAFETY LOAD SWITCHING CIRCUIT

CROSS-REFERENCE TO RELATED APPLICATION

The present application is related to a concept disclosed in an application filed on Nov. 9, 1979 having Ser. No. 092,829, in the names of Robert A. Black and Gary A. Peterson, and assigned to the assignee of the present application.

BACKGROUND OF THE INVENTION

With the advent of solid state control logic means such as microcomputers or microprocessors, a whole new field of control devices has evolved. When these devices are used in condition control or process control applications, the solid state control logic means or microcomputer ultimately controls heavy duty electrical switching equipment, such as relays. While the microcomputer or microprocessor operations entail possible failure modes that must be guarded against, they also provide an almost unlimited ability to monitor and control related equipment in fail safe manners not previously available in the control art. The ability of the microprocessor or microcomputer to carry out a large number of control functions in an exceedingly short period of time makes this type of a device an ideal tool for monitoring and control of associated equipment.

In order to provide a degree of safety that is comparable with electromechanical types of devices, microprocessor or microcomputer type condition control systems must be operated with control routines that are significantly different than the mode of control applied to electromechanical types of units. These routines form types of safety checking modes for the device.

SUMMARY OF THE INVENTION

The present invention is directed to a condition control system that utilizes a control logic means or microcomputer that includes self-checking circuitry, as well as, a safety relay checking circuit that is capable of master or overall control of a load.

In the present invention, a safety relay is utilized having a contact that is in series with the load controlled by the overall controlled system. The safety relay and its contact are in turn operated through a solid state switch means in a unique manner. The safety relay is cycled before the system is started up to make sure that the safety contact in series with the load means is functional. This is monitored by a feedback circuit to the microprocessor or microcomputer. After this function has been verified, the operation of the safety relay is continuously checked by causing the solid state switch means that operates the relay to be momentarily turned "off" thereby deenergizing the relay. The relay is reenergized before it can mechanically change states and the cycle is sensed by a feedback interface means between the solid state switch means and the control logic means to the microcomputer. Unless the safety cycle is present, the microcomputer will shut down the load by deenergizing the normal load relays and/or the safety relay.

BRIEF DESCRIPTION OF THE DRAWING

The single FIGURE is a schematic representation of a burner control system utilizing a safety relay that has a contact in series with three typical fuel burner load elements.

DESCRIPTION OF THE PREFERRED EMBODIMENT

The disclosed novel condition control system is capable of being applied to any type of control application where relays are used as a final switching element to control a load means. The specific embodiment described will be a temperature or condition control system adapted to control a fuel burner in a safe manner.

The present embodiment specifically discloses a condition control system generally at 10, and a load means generally disclosed at 11 wherein the load means is a fuel burner. A pair of line voltage conductors 12 and 13 are disclosed supplying power through a normally closed limit control or switch 14. The normally closed limit switch 14 could be a fuel pressure limit, or other typical limit normally supplied in burner installations. The limit 14 would be in turn connected to a normally open controller 15. The controller 15 could be a conventional switch or thermostat that is used to initiate the operation of the condition control system 10 to in turn operate the fuel burner 11. The controller 15 is connected to a terminal 16 of the condition control system 10, while the conductor 13 is connected to a terminal 17 of the condition control system 10.

The fuel burner means would further include a flame sensor means 20 that would be connected to a pair of terminals 21 and 22 that in turn connected to a conventional flame amplifier 23 that is within the condition control system 10. The simplified burner or load means 11 is completed by the connection of a main fuel valve 24, a source of ignition 25, and a pilot fuel valve 26 to the conductor 13 and to a series of terminals 30, 31, and 32. It is understood that any number of additional burner load elements could be added, but three have been shown by way of example. The condition control system 10 supplies power to the terminals 30, 31, and 32 in a manner that will be described subsequently in order to properly program or operate the fuel burner or load means 11.

The condition control system 10 utilizes four relays to operate the load means or burner 11 in a safe manner. The four relays are disclosed as relays 33, 35, 37, and 40. The relay 33 has a normally open pair of contacts 34 and these contacts act as safety contacts for the overall system. The relays 35, 37 and 40 each have normally open contacts disclosed at 36, 38, and 41. The contacts 36, 38, and 41 act as load contacts to control the load means with each of the contacts 36, 38, and 41 controlling a single one of the burner control elements. The relay contacts 36 are connected to the terminal 30 to control the main fuel valve 24. The normally open relay contacts 38 are connected to terminal 31 to control the ignition device 25. The relay contacts 41 are connected to the terminal 32 to control the pilot valve 26. A common conductor 42 connects each of the relay contacts 36, 38 and 40 in a common energizing circuit that in turn is connected to one side of the normally open contacts 34. The other side of the normally open contacts 34 is connected by conductor 43 to the terminal 16 where power can be applied through the controller 15 to the condition control system. It will be noted that when power is supplied to the conductor 43, and if the contacts 34 are closed, that all of the contacts 36, 38 and 41 are in a position to supply power to the main valve 24, the ignition means 25, and the pilot valve 26 through circuits to the conductor 13. With the circuitry disclosed to this point, it is quite obvious that it is possible to deenergize the individual load elements or means 24, 25 and 26 by operation of their individual relay contacts 36, 38, or 41, or it is possible to deenergize all of them at once by opening the contacts 34. The contacts 34 are safety contacts. Their operation is unique and provides part of the safety function of the present condition control system 10.

Each of the relay contacts 34, 36, 38, and 41 are monitored by an isolated signal transmission means. Two different types of isolated signal transmission means have been specifically disclosed but there are additional types that could be used. The two types disclosed are opto-isolators and auxiliary relay contacts. In addition to the two disclosed types it would be possible to use a reed relay with isolated contacts for the isolated signal transmission means. Where similar isolated signal transmission means have been disclosed for the contacts 34, 36, and 41 similar numbers will be used for identifying the operational parts.

The opto-isolators or isolated signal transmission means 45 which are used with the contacts 34, 36, and 41 include a voltage dropping resistor 46, a light emitting diode 47 and a further diode 48 in reverse parallel with the light emitting diode 47. The resistor 46 and the light emitting diode 47 are connected between the relay contacts 34 and the terminal 17 via a common conductor 50 that acts as a common conductor to the supply conductor 13 for the overall system. The isolated signal transmission means or opto-isolator 45 is completed by a photo-responsive transistor 51 that has its base connected through a resistor 52 to its emitter 53 with the emitter connected to ground 54. The transistor 51 is supplied with power from a terminal 55 through a dropping resistor 56 to a junction 57 so that as the transistor is switched "on" and "off" by a light from the light emitting diode 47, there is either a ground potential at the junction 57 or there is a positive voltage from the terminal 55. The isolated signal transmission means or opto-isolator 45 provides a digital 0 (ground) or a digital 1 (a positive voltage) that can be fed back in the condition control system 10 to indicate the status of the monitored relay contacts. It will be noted that each of the opto-isolators disclosed are identical and that they each have a common point 57. At this common point a series of conductors 58, 59, and 60 have been identified. The conductors 58, 59, and 60 have been individually identified so that their functions can be related to their associated relay contacts. In this case the relay contacts 34 provides a monitored signal on conductor 58, the relay contacts 36 is provided with a monitored signal on conductor 59, and the relay contacts 41 have a monitored signal on conductor 60.

The relay contact 38 is monitored by a different type of isolated signal transmission means that is disclosed generally at 61. The isolated signal transmission means disclosed at 61 includes normally closed relay contacts 62 that are mechanically coupled at 63 to the armature that drives or controls the relay contacts 38 so that when the relay contacts 38 close, the relay contact 62 opens. The reverse of this function could be provided if desired and the relay contacts 62 could be normally open contacts that close in conjunction with contacts 38. The contacts 62 are grounded at 54 and are supplied with power from a terminal 55 through a dropping resistor 56 to a common junction 57. It is quite apparent that when the relay contacts 62 are shorted, that the ground or a digital 0 appears at point 57. When the relay contacts 62 are open there is a voltage present at junction 57 and therefore a digital 1 appears. A conductor 64 is connected to the junction 57 of the isolated signal transmission means for the relay contacts 38.

At this point, it is apparent that each of the relays 35, 37, and 40 individually controls part of the load means or fuel burner by individually controlling the contacts 36, 38, and 41 to the main valve 24, the ignition 25, or the pilot valve 26. It is also apparent that the safety relay 33, by controlling the single pair of contacts 34 controls power to all parts of the load. Each of the relay contacts is monitored by an isolated signal transmission means that supplies a digital feedback signal on the conductors 58, 59, 60, and 64. The balance of the condition control system 10 will now be described, along with how it controls the individual relays and provides the unique safety function of the present invention.

The condition control system 10 is operated under the control of a control logic means 65 which can be a microcomputer or microprocessor. The control logic means 65 is powered and operated in a conventional manner for a device such as a microprocessor, and only the inputs and outputs that are necessary for the present invention have been disclosed. The control logic means 65 has a ground 66 that is common to the system, and receives an input control signal at 67 through a buffer 68 that is connected by a conductor 70 to the terminal 16. Whenever the terminal 16 receives power through the controller or thermostat 15, power is supplied as a control signal to the control logic means 65 to initiate the operation of the overall condition control system 10.

Also supplied as an input to the control logic means 65 is a conductor 71 that is connected to the flame amplifier 23 and the conductor 71 thus supplies the control logic means 65 with the indication from the load means or fuel burner 11 as to the status of whether a flame exists or does not exist in the burner so that that information can be used in a conventional fashion in the burner control system. The control logic means 65 receives as inputs the conductors 58, 59, 60 and 64 from the isolated signal transmission means 45 and 61 so that the control logic means 65 can function in response to the status of the monitored relay contacts.

The control logic means 65 has a number of output signals and of those there is disclosed an output signal on conductor 72 to a safety circuit 73 that in turn provides a feedback signal at 74 to the control logic means 65, and simultaneously provides an output control signal on conductor 75 to a solid state switching means 76. The details of the safety circuit 73 are not material to the present invention, but have been disclosed in block form to indicate the flow direction of logic from the control logic means 65 to the solid state switching means 76. For the purposes of the present invention, the output on the conductor 72 could be considered as a driving signal directly for the solid state switch means 76. The solid state switching means 76 is grounded at 77 to a common ground in the system. The solid state switching means 76 has an output at 80. The output at 80 is connected directly by a conductor 81 to the relay 33 which in turn is connected by a common conductor 82 to a source of potential 83 that is used to drive all of the relays 33, 35, 37, and 40. The output 80 is further connected to a feedback interface means 84 to the control logic means 65. The feedback interface means 84 includes a dropping impedance 85, an inverter 86, and a diode 87 that is connected intermediate the impedance 85 and the inverter 86. The diode 87 is further connected to a source of potential 88. The feedback interface means 84 provides the control logic means 65 with a digital signal which is representative of the status of the solid state switching means 76. The feedback interface means 84 is capable of advising the control logic means 65 whether the relay 33 is being energized or deenergized by the operation of the solid state switch means 76 in response to a signal supplied on the conductor 72 from the control logic means 65. This control loop is important to the present invention and its operation will be further explained in connection with the general description of operation of the present invention.

The disclosure is completed by the conductors 90, 91, and 92 from the relays 35, 37, and 40 respectively. The conductors 90, 91, and 92 connect into the control logic means 65 and wherein the control logic means 65 is capable of selectively grounding the relays 35, 37, and 40 to cause them to operate from the potential supplied from the terminal 83.

OPERATION

The operation of the present control system 10 to sequence the fuel burner or load means 11 will be explained in conjunction with a highly simplified form of fuel burner arrangement. The number of individual loads and their sequencing can be far more complex and sophisticated than the limited number of loads disclosed, but the application of the control principle of the present invention to a larger group of loads will be quite apparent from the explanation supplied.

Before the fuel burner 11 is to be put into operation its normal state would be to have the main fuel valve 24 and the pilot fuel valve 26 in an "off" state with the ignition 25 also in an "off" state. As such, the relay contacts 36, 38, and 41 would be open. The flame sensor 20 would be exposed to a dark ambient and the flame amplifier 23 would be advising the control logic means 65 that no flame exists. The safety relay 33 is deenergized and the contacts 34 are open. At this same time the external limit 14 is closed and the controller 15 is open thereby providing no power to the system.

Upon the closing of the controller or thermostat 15, the terminal 16 along with the terminal 17 are supplied with a conventional source of power. Since the relay contacts 34 are open, no power can be supplied downstream to the conductor 42 and any of the load means 24, 25, or 26. The fact that the controller or thermostat 15 has closed is communicated to the control logic means 65 via the conductor 71 and the control logic means 65 then starts a control sequence that is programmed into it.

The control sequence programmed into the control logic means 65 causes the control logic means to look at the input from conductor 58 of the isolated signal transmission means 45 to determine the status of the contacts 34. The contacts 34 should be in an open state indicating that it is capable of deenergizing the loads 24, 25, and 26. The safety relay 33 is then cycled by a signal on conductor 72 to the solid state switching means 76 where the solid state switching means 76 completes a circuit between the conductor 81 and the ground 77 to energize the relay 33. This change in state is communicated through the feedback interface means 84 to the control logic means 65 which verifies that the solid state switching means 76 has operated. The operation of the safety relay 33 closes the contacts 34 and the closing of these contacts supplies power to the conductor 42. Simultaneously, a change in the isolated signal transmission means signal on conductor 58 is supplied to the control logic means 65 to verify that the contacts 34 have closed. It should be noted that the relay 33 and contacts 34 can be cycled at this point since the contacts 36, 38, and 41 are open and the loads 24, 25, and 26 would remain deenergized. The cycling of the safety relay 33 and its associated contacts 34 is accomplished to verify that the safety relay means 33 and its associated contacts 34 are capable of opening the circuit to the loads 24, 25, and 26. Also, during the start-up of every burner sequence, that is after each subsequent operation of controller 15, the safety relay contacts 34 are opened (during a pre-purge portion of the burner cycle), are checked, and then closed again. This insures that the safety contacts 34 are functionally available to operate to drop all the loads if necessary.

After the cycling of the safety relay means 33 and its verification from the isolated signal transmission means conductor 58, the control logic means 65 starts the normal sequence of operation of the fuel burner 11. The control logic means 65 completes a ground circuit on conductor 91 for the ignition relay 37 and the contacts 38 are closed. The closing of the contacts 38 is verified by the operation of the contacts 62 and the isolated signal transmission signal on conductor 64. The control logic means 65 then initiates the operation of the pilot valve means 26 by the operation of the relay 40 by grounding the conductor 92 in the control logic means 65. This immediately closes the contacts 41 and advises the control logic means 65 of this function via the conductor 60 from the isolated signal transmission means 45. After the establishment of the pilot flame, the flame amplifier 23 supplies the control logic means 65 a signal on conductor 71 that a flame is present and the control logic means 65 then energizes the main valve relay 35 by grounding the conductor 90. This opens the main valve 24 and initiates the full operation of the burner.

At this time, the ignition 25 and pilot valve 26 may be deenergized depending upon the type of cycle. Also the condition control system could have a fuel burner that had previously operated a pre-purge blower, and it would have been connected into the system 11 as a load similar to any of the loads currently disclosed. The specific type of burner sequences is not material, and it is quite obvious that the control logic means 65 is capable of controlling any number of loads in a fashion disclosed in connection with the loads 24, 25, and 26.

In order to verify the safety of the system, during the operation of the fuel burner means 11, the solid state switching means 76 is operated momentarily by the control logic means 65 and the power is removed from the safety relay 33. This information is immediately supplied by the feedback interface means 84 to the control logic means 65. The control logic means 65 then reenergizes the relay 33 by operation of the solid state switching means 76. This operation occurs so rapidly that the mechanical inertia of the relay 33 and its associated armature does not allow the contacts 34 to open. This safety cycling verifies the status of the solid state switching means 76 which is part of the safety circuit for the safety relay 33. Any malfunction in the solid state switching means 76 which would prevent the relay 33 from opening the contacts 34 is immediately sensed by the control logic means 65 and the individual relays 35, 37, and 40 can then be deenergized to drop the loads in a safe fashion.

It is noted that the relay contacts 34 not only are cycled at the start up of the sequence, but that they are cycled without any load current. Since they are cycled "dry" there is little or no chance that the contacts 34 could weld. This leaves the contact 34 as a complete safety in the event that any of the contacts 36, 38, or 41 should weld in their normal operation. If any of the load contacts 36, 38, or 41 weld, the failure of operation of that contact is fed back through the isolated signal transmission means 45 or 61 when the associated relay is designated to operate. The control logic means 65 immediately senses any failure of the contacts 36, 38, or 41 and the safety relay means 33 is allowed to immediately open contacts 34 which are in series with all of these loads. Since the contacts 34 are in series with all of the loads 24, 25, and 26 their operation immediately drops out all of the loads in a safe manner and shuts down the fuel burner.

With the invention disclosed it is apparent that a safety relay arrangement has been provided wherein the safety relay has contact that are verified before a load is provided through the contacts. The contacts are thus available to drop any of the loads downstream which might be accidentally locked in place due to a welding of relay contacts or other type of failure. The solid state switching means which controls the safety relay is regularly checked by momentarily deenergizing the relay and then reenergizing it before the relay can physically drop out. The operation of the solid state switching means 76 is verified by a feedback interface means 84 to the control logic means 65 thereby providing two forms of safety for the safety relay 33 to insure that any type of a malfunction within the switching circuit for the relay or in its contacts can be identified and the system shut down. Since the safety relay contacts 34 are checked before the operation of each cycle, and since the electronics of the solid state switch means 76 is verified regularly during any operating sequence, the control logic means 65 has the capability of safety shutting down the system in the event of any type of a malfunction either in the safety relay, its electronics, or in the operation of any of the individual loads.

The present invention has been disclosed in a highly simplified form. The present condition control system when operating a fuel burner load normally would have as many as six or eight load relays having many further functions that are controlled by the logic control means or microcomputer 65. The simplification of this disclosure has been provided as a means of conveying the inventive concept and is not a form of limitation on the scope of the present invention. The scope of the present invention is defined solely by the scope of the appended claims.

The embodiments of the invention in which an exclusive property or right is claimed are defined as follows:

1. A condition control system adapted to be connected to load means to operate said load means in a safe manner, including: safety relay means controlled by solid state switching means and including contact means with said contact means connected in a series energizing circuit for said load means; load relay means having load contact means connected to energize said load means in response to said condition control system; said load contact means connected intermediate said safety contact means and said load means so that either said safety contact means or said load contact means can deenergize said load means; control logic means connected to control said solid state switching means to in turn control said safety relay means; said control logic means further connected to control said load relay means to operate said load means; and feedback interface means connecting said solid state switching means and said control logic means; said control logic means periodically changing the state of energization of said solid state switching means and said safety relay means; said control logic means verifying the operation of said solid state switch means from said feedback interface means prior to said safety relay means physically operating; said control logic means restoring the original state of energization of said safety relay means before said safety relay means is capable of physically operating upon verifying from said feedback interface means that said solid state switching means had properly operated.

2. A condition control system as described in claim 1 including isolated signal transmission means connected between said safety relay contact means and said control logic means; and said isolated signal transmission means providing said control logic means with a signal indicative of the status of said safety relay contact means; said control logic means responding to said signal to deenergize said load means if said signal indicates that said safety contact means is improperly closed.

3. A condition control system as described in claim 2 including load responsive isolated signal transmission means connected between said load relay contact means and said control logic means; and said load responsive isolated signal transmission means providing said control logic means with a further signal indicative of the status of said load relay contact means; said control logic means responding to either of said signals to deenergize said load means if either of said signals indicates that said contact means is improperly closed.

4. A condition control system as described in claim 3 wherein said load means is a fuel burner including fuel supply means controlled by said load contact means.

5. A condition control system as described in claim 4 wherein said isolated signal transmission means are opto-isolators; and said relay contact means are pairs of relay contacts.

6. A condition control system as described in claim 4 wherein said relay contact means are pairs of relay contacts; and said isolated signal transmission means includes auxiliary relay contacts operated in unison with said relay contact means to supply said further signal to said control logic means.

7. A condition control system as described in claim 5 wherein said control logic means is a microcomputer which is capable of periodically changing the state of energization of said solid state switching means and responding to said isolated signal transmission means to safely operate said fuel burner.

8. A condition control system as described in claim 6 wherein said control logic means is a microcomputer which is capable of periodically changing the state of energization of said solid state switching means and responding to said isolated signal transmission means to safely operate said fuel burner.

9. A condition control system as described in claim 7 wherein said feedback interface means includes impedance means and a clamping diode to supply said microcomputer with a voltage level shift indicative of the operation of said solid state switching means.

10. A condition control system as described in claim 9 wherein said fuel burner load includes a plurality of relay controlled loads; each of said relay controlled loads having an isolated signal transmission means connected between said individually controlled loads and said microcomputer.

* * * * *